US006929573B1

(12) United States Patent
Chang

(10) Patent No.: US 6,929,573 B1
(45) Date of Patent: Aug. 16, 2005

(54) BAT FOR BASEBALL

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 0 days.

(21) Appl. No.: 10/796,006

(22) Filed: Mar. 10, 2004

(51) Int. Cl.[7] ..... A63B 59/06
(52) U.S. Cl. ..... 473/567; 473/566
(58) Field of Search ..... 473/564–568, 473/457, 519, 520

(56) References Cited

U.S. PATENT DOCUMENTS

| | | | | | |
|---|---|---|---|---|---|
| 377,686 | A * | 2/1888 | Moose | 473/564 |
| 1,499,128 | A * | 6/1924 | Shroyer, Jr. | 473/519 |
| 2,379,006 | A * | 6/1945 | Johnson | 473/568 |
| 3,116,926 | A * | 1/1964 | Owen et al. | 473/457 |
| 4,274,631 | A * | 6/1981 | Hayazaki | 473/457 |
| 4,898,386 | A * | 2/1990 | Anderson | 473/457 |
| 5,114,144 | A * | 5/1992 | Baum | 473/567 |
| 5,133,551 | A * | 7/1992 | Handy et al. | 473/567 |
| 5,219,164 | A * | 6/1993 | Peng | 473/520 |
| 5,303,917 | A * | 4/1994 | Uke | 473/567 |
| 6,139,451 | A * | 10/2000 | Hillerich et al. | 473/564 |
| 6,432,006 | B1 * | 8/2002 | Tribble | 473/564 |
| 6,485,382 | B1 * | 11/2002 | Chen | 473/566 |
| 6,511,392 | B1 * | 1/2003 | Chohan | 473/564 |
| 6,609,984 | B1 * | 8/2003 | Tribble | 473/564 |
| 6,669,584 | B1 * | 12/2003 | Miller | 473/568 |
| 2002/0107095 | A1 * | 8/2002 | Becker | 473/564 |
| 2003/0013563 | A1 * | 1/2003 | Ryan | 473/457 |

* cited by examiner

*Primary Examiner*—Mark S. Graham
(74) *Attorney, Agent, or Firm*—Browdy and Neimark, P.L.L.C.

(57) ABSTRACT

An improved baseball bat comprises a tubular core of rigid materials having a first section to support a handle and a second section to support a striking portion. The second section of the core has a diameter relatively larger that of the first section of the core. A covering member of semi-rigid materials has a handle portion embracing the first section of the core and a striking portion embracing the second section of the core. Whereby, the baseball bat has a light weight, good equilibrium, and high structural strength for a good performance.

12 Claims, 2 Drawing Sheets

BAT FOR BASEBALL

BACKGROUND OF THE INVENTION

1. Field of the Invention

The present invention relates to bats for baseball and, more particularly, to an improved bat for baseball, which has an inner core made of rigid materials and an outer covering member made of semi-rigid materials.

2. Description of the Related Art

Wooden bats are most popularly used because they are the cheapest ones. However, wooden bats have numerous drawbacks, such as heavy weight and bad equilibrium. Furthermore, a wooden bat is weak and easy to break, and produces severe shocks when hitting the ball.

In comparison to wooden bats, an aluminum bat is relatively lighter in weight, and has an ideal equilibrium. Therefore, the performance of an aluminum bat is superior to conventional wooden bats, and an aluminum bat is more durable than conventional wooden bats. Further, the price of aluminum bats is reasonable. However, an aluminum bat produces shocks, noises and dents at barrel when hitting the ball.

The recently developed bats made of fiber reinforced plastic (FRP) material have the ideal counterweight and equilibrium and high performance in hitting. In addition, a FRP bat has a strong structural strength, and does not break easily. However, The problem is that the FRP bat is too expensive to get a popular use.

SUMMARY OF THE INVENTION

It is one object of the present invention to provide a baseball bat having a light weight, good equilibrium, and high structural strength for a good performance.

It is another object of the present invention to provide an improved bat for baseball having a shock absorbability better than that of the prior art baseball bat.

It is still another object of the present invention to provide a baseball bat, which has its center of gravity adjustable.

It is still another object of the present invention to provide a baseball bat having a well protected surface.

To achieve these and other objects of the present invention, an improved baseball bat according to the present invention comprises a tubular core of rigid materials having a first section to support a handle and a second section to support a striking portion. The second section of the core has a diameter relatively larger than that of the first section of the core. A covering member of semi-rigid materials has a handle portion embracing the first section of the core and a striking portion embracing the second section of the core.

BRIEF DESCRIPTION OF THE DRAWINGS

These and other objects of the present invention will become more clear upon a through study of the following description of the best mode for carrying out the present invention, particularly when reviewed in conjunction with the drawings, wherein.

DETAILED DESCRIPTION OF THE INVENTION

Figure 1:
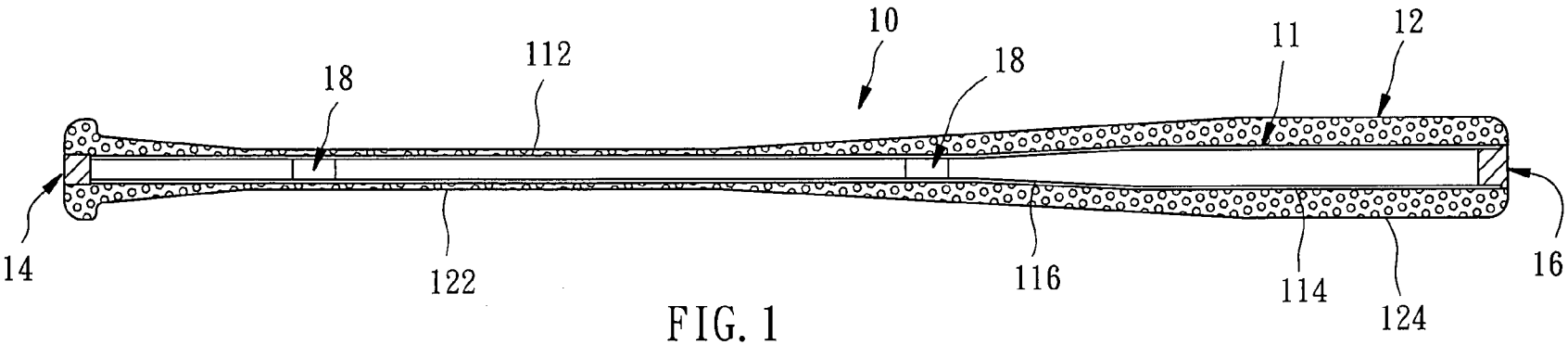
FIG. 1 is a longitudinal sectional view of a baseball bat constructed according to the first embodiment of the present invention.

With reference first to FIG. 1, a baseball bat, referenced by 10, in accordance with the first embodiment of the present invention is shown comprising a tubular core 11, a covering member 12, a front plug 14, a rear plug 16 and two weights 18.

The tubular core 11 is made of rigid materials, such as composite materials, metals and plastics. In this embodiment, it is a carbon-fiber reinforced epoxy resin. The core has a first section 112, a second section 114 and a middle section 116 between them. The diameter of the second section 114 is relatively larger than the diameter of the first section 112, and the diameter of the middle section 116 is gradually increased in direction from the first section 112 toward the second section 114.

The covering member 12 is made of semi-rigid materials, such as foam plastic materials or wood. In this embodiment, it is a Polyurethane (PU) foam material. The covering member 12 has a handle portion 122 and a striking portion 124. The handle portion 122 embraces the first section 112 and the middle section 116 of the core 11. The striking portion 124 embraces the second section 114.

The weights 18 are inserted into the first section 112 of the core 11, and adapted to adjust the center of gravity of the bat 10. The weights 18 can be made of shock-absorbing materials to lessen shocks upon hitting a pitched ball of the bat 10 against the ball.

Figure 2:
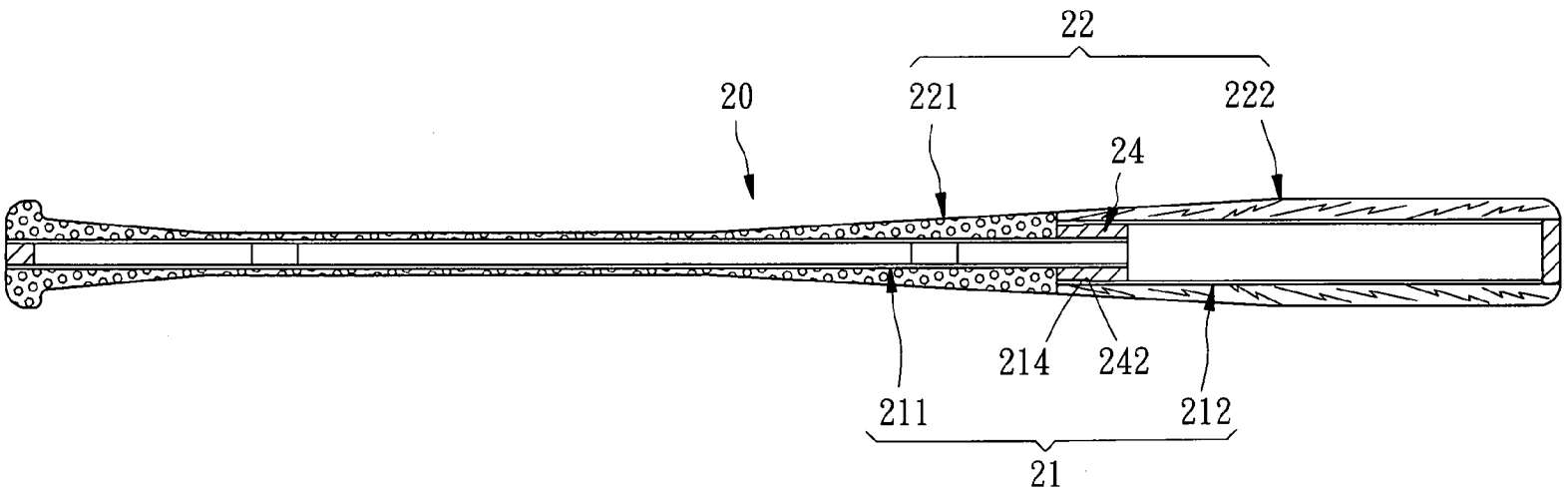
FIG. 2 is a longitudinal sectional view of a baseball bat constructed according to the second embodiment of the present invention.

In production, the bat can be variously embodied. FIG. 2 shows a bat 20 constructed according to the second embodiment of the present invention. According to this embodiment, the bat 20 is similar to the bat 10 of the first embodiment. The difference is that the bat 20 includes a core 21 combined by a first section 211 and a second section 212 which are made respectively, and a covering member 22 having a handle portion 221 made of foam plastic materials and a striking portion 222 made of wood. The handle portion 221 embraces the first section 211. The striking portion 222 embraces the second section 212.

The two sections 211, 212 of the core 21 can be connected by a connecting means 24. In this embodiment, the connecting means 24 is a ringlike device inserted tightly into the rear end of the second section 212. The rear end of the second section 212 forms an inner shoulder 214 to complementedly connect with an outer shoulder 242 formed on the ring-like device 24. The front end of the first section 211 is thereby engaged fixedly into the ringlike device 24.

Figure 3:
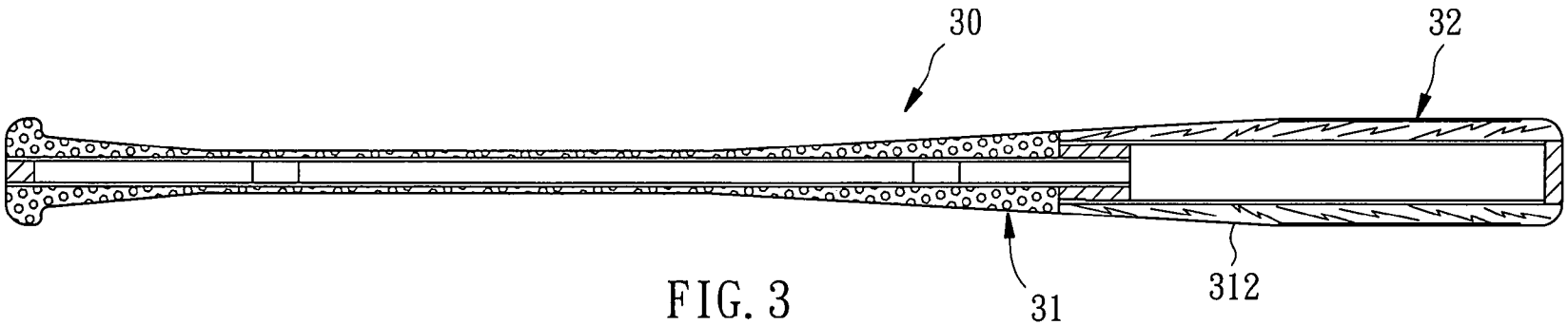
FIG. 3 is a longitudinal sectional view of a baseball bat constructed according to the third embodiment of the present invention.

FIG. 3 shows a baseball bat 30 constructed according to the third embodiment of the present invention. According to this embodiment, the bat 30 is similar to the bat 20 of the second embodiment. The difference is that the bat 30 further includes a protecting layer 32 made of fiber-reinforced material. The protecting layer 32 wraps around the surface of the striking portion 312 of the covering member 31. Whereby, the bat 30 can get an external reinforcing provided by the protecting layer 32.

Figure 4:
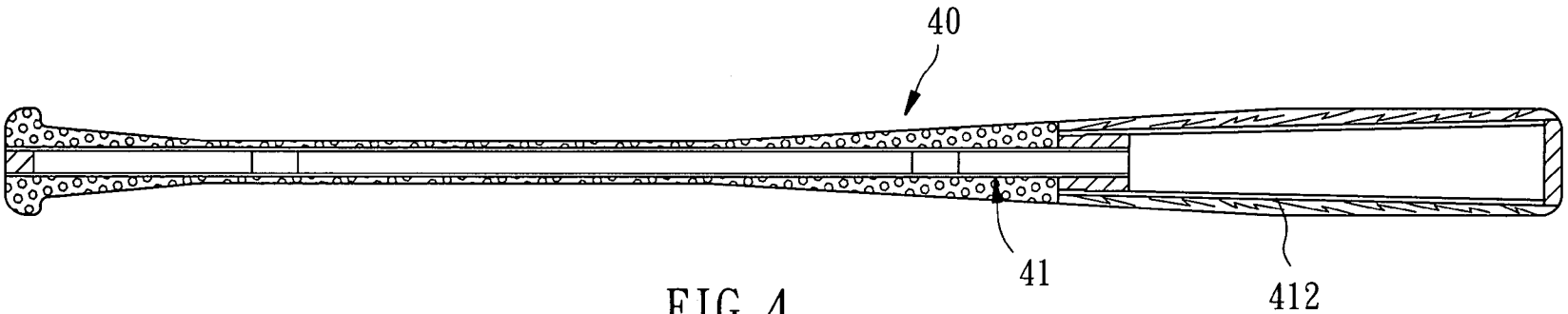
FIG. 4 is a longitudinal sectional view of a baseball bat constructed according to the fourth embodiment of the present invention.

FIG. 4 shows a base bat 40 constructed according to the fourth embodiment of the present invention. According to this embodiment, the bat 40 is similar to the bat 20 of the second embodiment. The difference is that the bat 40 has a tubular core 41 with a second section 412 taperedly formed. As shown in this drawing, the diameter of the second section 412 is gradually increased in direction from the front end thereof toward the rear end thereof.

Figure 5:
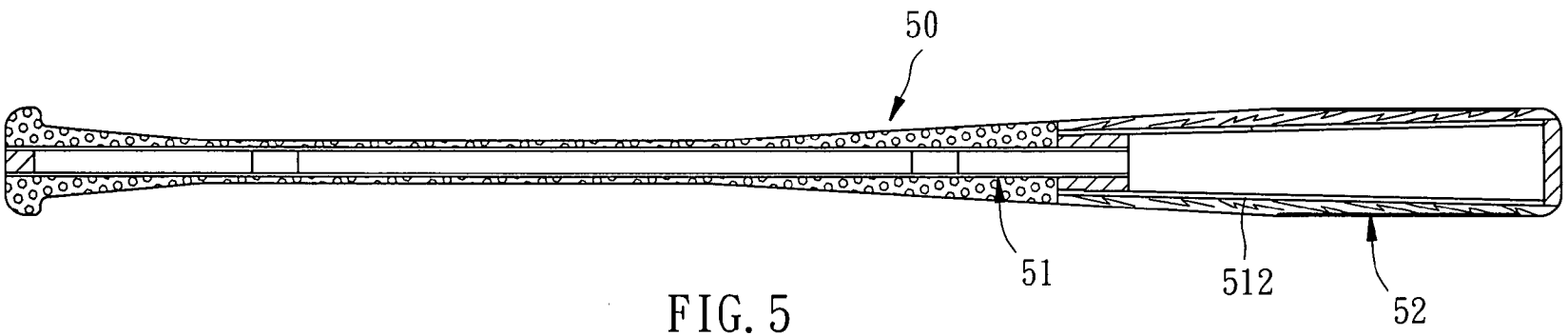
FIG. 5 is a longitudinal sectional view of a baseball bat constructed according to the fifth embodiment of the present invention.

FIG. 5 shows a baseball bat 50 constructed according to the fifth embodiment of the present invention. According to this embodiment, the bat 50 is similar to the bat 40 of the fourth embodiment. The difference is that the bat 50 further includes a protecting layer 52 made of fiber-reinforced material. The protecting layer 52 wraps around the surface of the striking portion 512 of the covering member 51. Whereby, the bat 50 can get an external reinforcing provided by the protecting layer 52.

Summarily speaking, the baseball bats mentioned above have numerous advantages as follows:

1. For having the covering member made of semi-rigid materials, the protecting outer layer, and being reinforced by the tubular core made of rigid materials, the bat has a relatively lower specific gravity than conventional wooden bats and would not be broken or deformed easily. In addition, the total weight of the bat is relatively lighter than conventional wooden bats.

2. Because the core of the bat is inserted into the weights, the center of gravity of the bat can be adjusted within the area between 14~14.5 inches distanced from the barrel end thereof.

3. For having the handle portion made of foam plastic materials and the shock-absorbing members inserted inside the core, the bat can absorb shocks upon hitting a pitched ball, preventing sport injury to the user.

4. The bat does not cause noises like an aluminum bat when hitting the ball.

5. The bat has all advantages of a FRP bat but has a lower manufacturing cost comparing with that of a FRP bat.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An improved baseball bat comprising:

a tubular core of rigid materials having a first section to support a handle and a second section to support a striking portion, said second section having a diameter relatively larger that of said first section;

a covering member of semi-rigid materials having a handle portion embracing said first section of said core and a striking portion embracing said second section of said core;

wherein said first section and second section of said core are respectively made and connected by a connecting means; and wherein said connecting means is a ringlike device inserted tightly into one end of said second section of said core.

2. The baseball bat as claimed in claim 1, wherein said core is made of a material selected from a group consisting of composite materials, metals and plastics.

3. The baseball bat as claimed in claim 2, wherein said core is made of fiber-reinforced plastic materials.

4. The baseball bat as claimed in claim 1, wherein said handle portion of said covering member is made of foam plastic materials and said striking portion of said cover is made of wood materials.

5. The baseball bat as claimed in claim 1, wherein the end of said second section of said core has an inner shoulder to complementedly connect with an outer shoulder formed on said ringlike device.

6. The baseball bat as claimed in claim 1, wherein said second section of said core is taperedly formed.

7. The baseball bat as claimed in claim 1, further comprising a protecting layer made of fiber-reinforced material and wrapping around the surface of said striking portion of said covering member.

8. The baseball bat as claimed in claim 1, further comprising at least one shock-absorbing device respectively and tightly inserted inside said core.

9. The baseball bat as claimed in claim 1, further comprising at least one weight device respectively and tightly inserted inside said core.

10. The baseball bat as claimed in claim 2, wherein the end of said second section of said core has an inner shoulder to complementedly connect with an outer shoulder formed on said ringlike device.

11. The baseball bat as claimed in claim 3, wherein the end of said second section of said core has an inner shoulder to complementedly connect with an outer shoulder formed on said ringlike device.

12. The baseball bat as claimed in claim 4, wherein the end of said second section of said core has an inner shoulder to complementedly connect with an outer shoulder formed on said ringlike device.

* * * * *